US005651173A

United States Patent [19]

Roy et al.

[11] Patent Number: 5,651,173

[45] Date of Patent: Jul. 29, 1997

[54] METHOD FOR DOUBLY UPSETTING TUBING FLANGES

[75] Inventors: William B. Roy, North Manchester; Brad A. Vigar, LaFontaine; Terry E. Steffen, Fort Wayne; Laral E. Turner, Claypool, all of Ind.

[73] Assignee: Whitley Products, Inc., North Manchester, Ind.

[21] Appl. No.: 410,725

[22] Filed: Mar. 27, 1995

[51] Int. Cl.[6] ..... B21D 39/04

[52] U.S. Cl. ..... 29/512; 285/382.5

[58] Field of Search ..... 29/890.144, 890.15, 29/509, 512, 523; 285/382.4, 382.5

[56] References Cited

U.S. PATENT DOCUMENTS 2,545,930 3/1951 Richardson ..... 285/87

4,980,961 1/1991 Caudill ..... 29/509

5,283,951 2/1994 Davenport et al. ..... 29/890.144

*Primary Examiner*—David P. Bryant

*Attorney, Agent, or Firm*—Roger M. Rickert

[57] ABSTRACT

A method of forming a collar backed doubly upset tubing end includes positioning the collar on the tube, gripping the tube in a die and finally positioning the collar coplanar with the die and with a preferred length of tube extending axially beyond the coplanar collar and die faces. The tube end is axially impacted by a frustoconical punch forcing the tube end axially toward the collar while allowing a tube portion intermediate the tube end and the collar to expand radially outwardly. The tube end is then axially impacted for a second and final time with a recessed flat punch to flatten the tube end. Apparatus for performing the method as well as the product produced thereby are also disclosed.

2 Claims, 5 Drawing Sheets

METHOD FOR DOUBLY UPSETTING TUBING FLANGES

SUMMARY OF THE INVENTION

The present invention relates generally to techniques for providing coupling flanges on tubing and more particularly to flat, collar backed, flanges for hydraulic couplings.

Tubing such as steel or copper is frequently deformed near an end to effect coupling to another tube or other fitting. The deformation may be a conical flare, an annular enlargement near the tube end, or deformation of the tube end into a relatively flat flange. One technique for the latter is a double upset backed by a collar or sleeve as taught, for example, in U.S. Pat. Nos. 4,980,961 and 5,283,951. Flanges of this type are frequently compressed by a nut against another relatively flat flange having a seal containing groove in high pressure hydraulic system connections and the like.

In the Caudill U.S. Pat. No. 4,980,961, a tube assembly is formed by placing a sleeve over an end portion of a tube and then placing the tube and sleeve in a die. A first punch enters the tube radially flaring the tube end. A second frustoconical punch crimps the tube end back radially inwardly forming an annular enlargement at the tube end. Finally, a third punch flattens this enlargement.

In the Davenport et al U.S. Pat. No. 5,283,951, a very similar tube assembly is formed by placing a sleeve over an end portion of a tube add then placing the tube and sleeve in a die. A first frustoconical punch engages the tube end compressing it axially to initiate an annular bulge near the tube end. A second much more shallow frustoconical punch expands the annular enlargement at the tube end. Finally, a third punch flattens this enlargement.

Thus, in each of these two patented arrangements, three separate press hits and three different punches are required to form the flattened end. It would be highly desirable to manufacture substantially the same type double upset, collar backed, flange utilizing a reduced number of steps and less equipment.

Among the several objects of the present invention may be noted the provision of an improved double upset end forming technique for tubing requiring a lower capital equipment expense and reduced manufacturing time as compared to the prior art, all contributing to a reduced per part cost. This as well as other objects and advantageous features of the present invention will be in part apparent and in part pointed out hereinafter.

In general, a method of forming a sleeve backed doubly upset end on an elongated tube for subsequent sealing with another member includes passing a sleeve over the undeformed end of a tube, and gripping the tube between die portions with a preferred length of tube extending axially beyond the sleeve. The sleeve is typically an annular rimmed collar having a relatively flat face in a plane orthogonal to the direction of tube elongation. The sleeve flat face is aligned coplanar with a corresponding relatively flat face of the die portions with the length of tube extending axially beyond the sleeve flat face and the corresponding die flat face by substantially the same preferred length. A pilot punch may be positioned radially inside the sleeve. The tube end is then axially impacted with a frustoconical punch forcing the tube end axially toward the sleeve while allowing a tube portion intermediate the tube end and the sleeve to expand radially outwardly. The tube end is then axially impacting for a second and final time with a recessed flat punch to flatten the tube end. The tube may then be released from between the die portions. As noted above, the overall cost and complexity of the equipment as well as the resulting cost of the flanged tubing sections is reduced according to the present invention by providing a two station punch and die apparatus for manufacturing hydraulic tubing connectors according to this technique.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
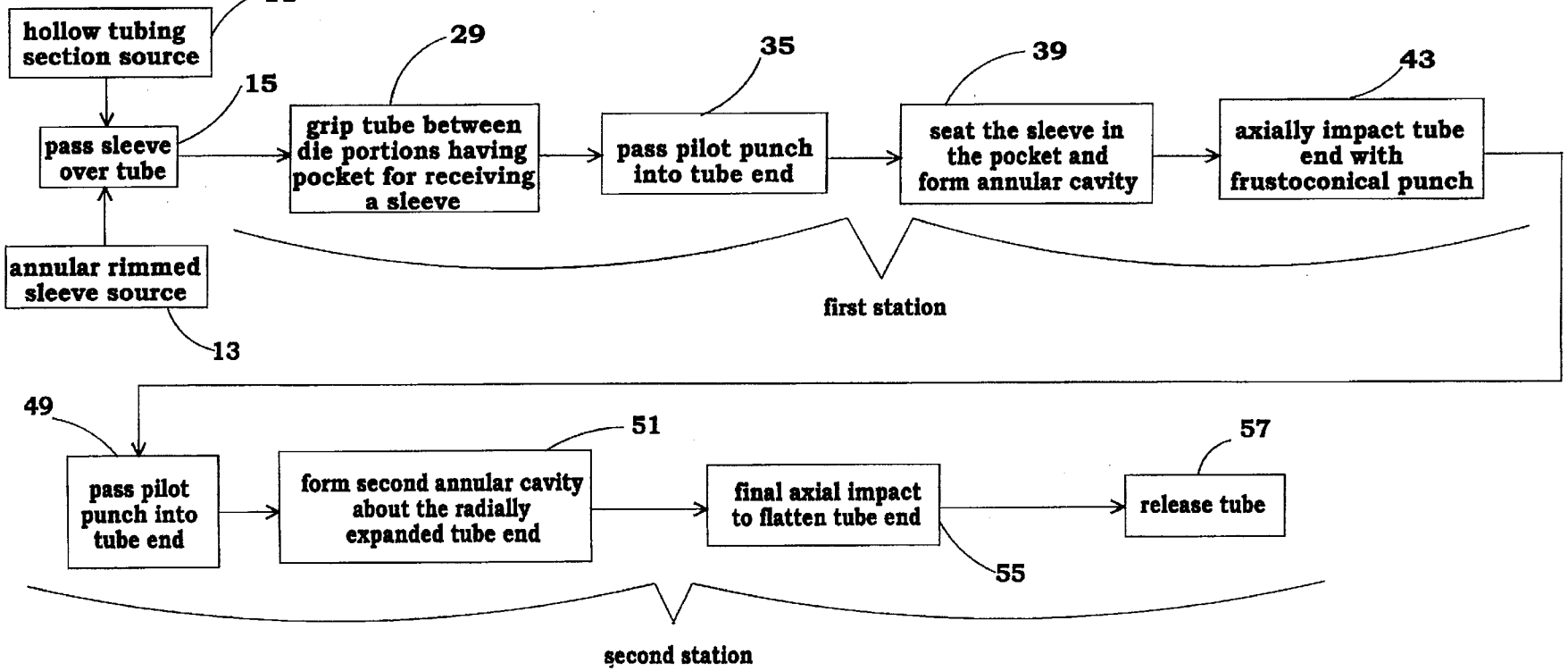
FIG. 1 is a block diagram illustrating the present inventive manufacturing technique.
Figure 2:
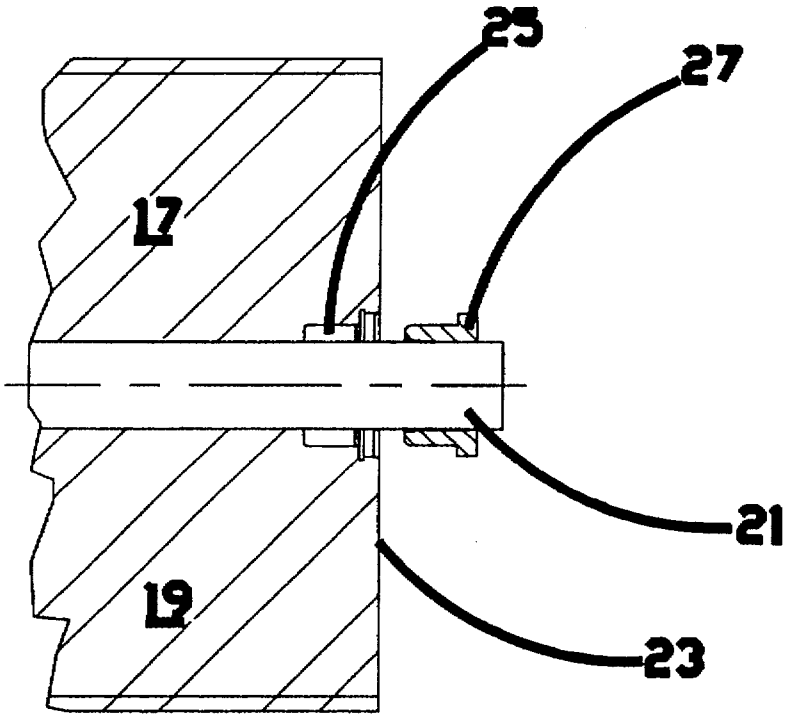
FIG. 2 is a cross-sectional view of an illustrative die for gripping tubing in the practice of the present invention.

In FIG. 1, the operation of a two station punch and die apparatus for manufacturing hydraulic tubing connectors is seen to include the source 11 of hollow tubing sections and the source 13 of annular rimmed sleeves or collars. The collars have inside diameters slightly greater than the outer diameter of the tubing sections so that a sleeve such as 27 may be passed over the end 21 of a section of tube at 15. The first step 29 in the operation of the first station is to grip the tubing section between the die portions 17 and 19 of FIG. 2. This die is similar to that used in forming common nails. The die portions 17 and 19 grip the tubing section with the end 21 thereof extending beyond the planar surface 23 of the die portions 17 and 19. The die of FIG. 2 also includes a pocket 25 for receiving the annular rimmed sleeve 27.

Figure 3:
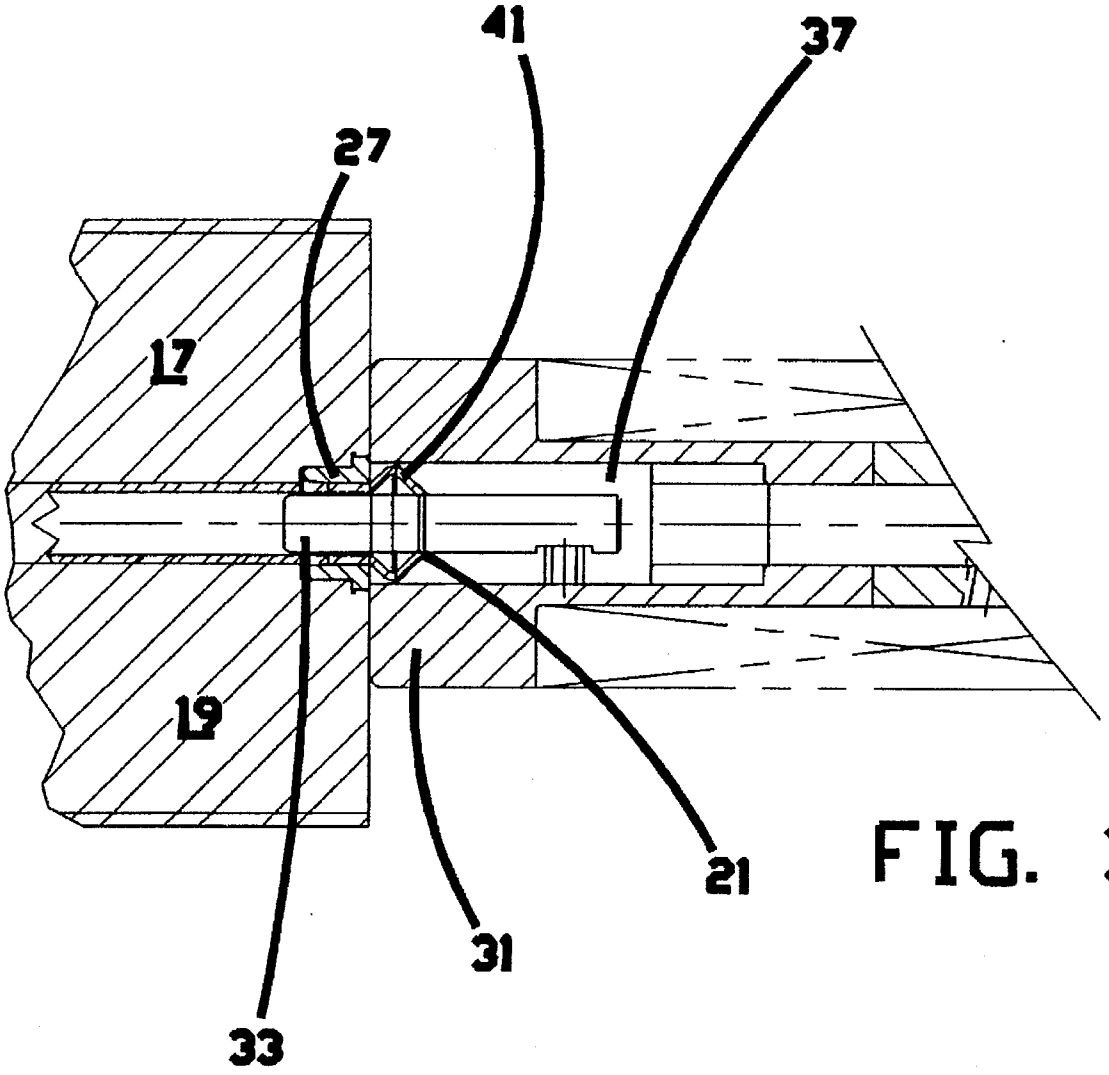
FIG. 3 is a cross-sectional view of an illustrative first station of a two station punch and die apparatus for manufacturing hydraulic tubing connectors according to the present invention.
Figure 5:
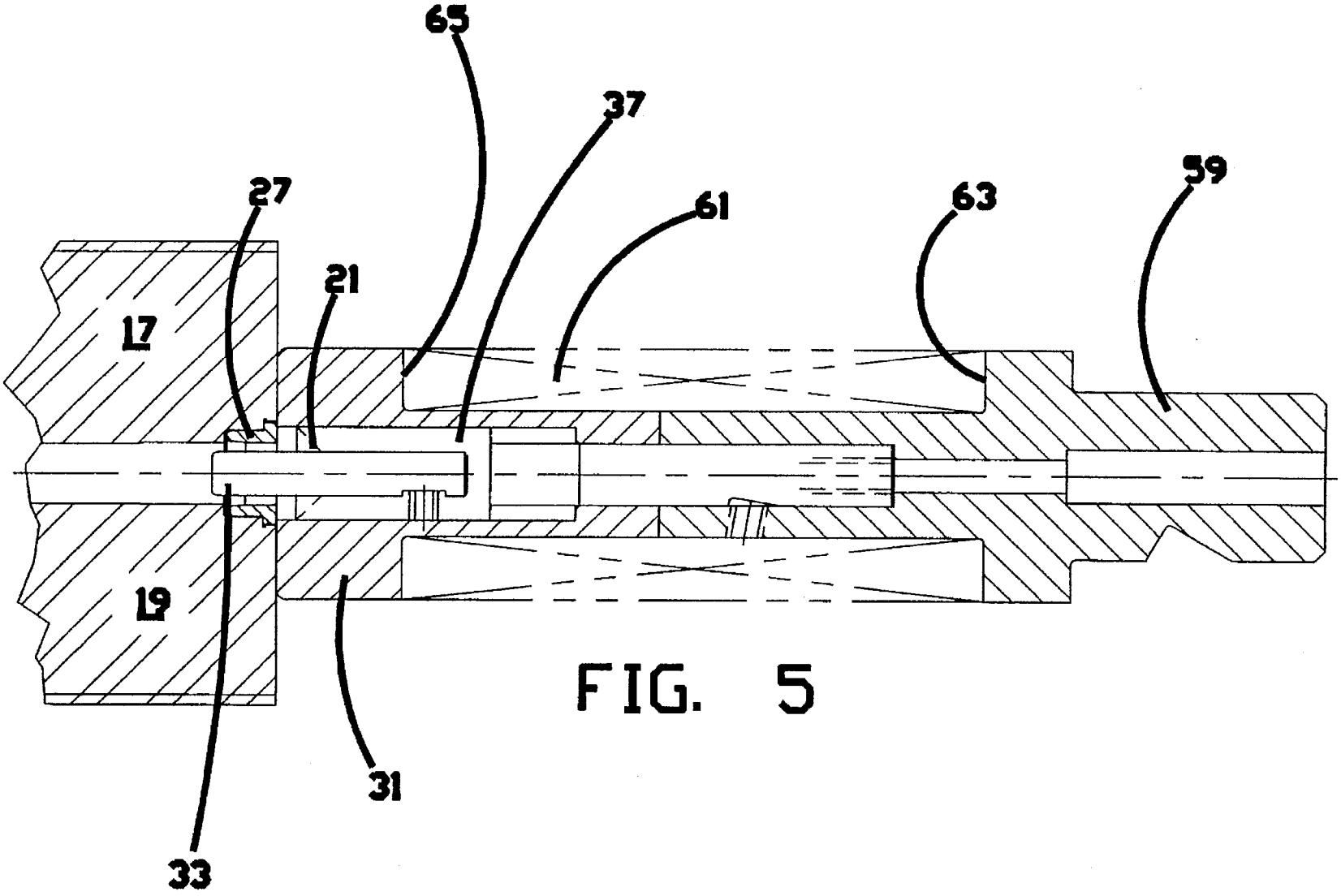
FIG. 5 is a cross-sectional view similar to FIG. 3, but showing the lost motion coupling between the outer and inner portions of the punch.

Once so gripped as illustrated at 29, an outer punch 31 and an alignment pin 33 of FIGS. 3 and 5 move into engagement with the extending end 21 of the die gripped tubing section. The alignment pin or pilot punch 33 is present at 35 to prevent collapsing of the tube during impact by punch 37. The outer punch 31 forces sleeve 27 downwardly into a securely seated position in the pocket 25 as shown at 39. This outer die also forms an annular cavity about the tubing section end as shown at 35. Punch 37 is movable within the annular cavity formed by the outer punch 31 into abutment with the tubing end to force the tubing end axially toward the sleeve 33 while allowing a tubing portion 41 intermediate the tubing end 21 and the sleeve 33 to expand radially outwardly within the annular cavity. This action is indicated generally at 43 in FIG. 1 and represents the final formation of the tube within the first stage.

Figure 4:
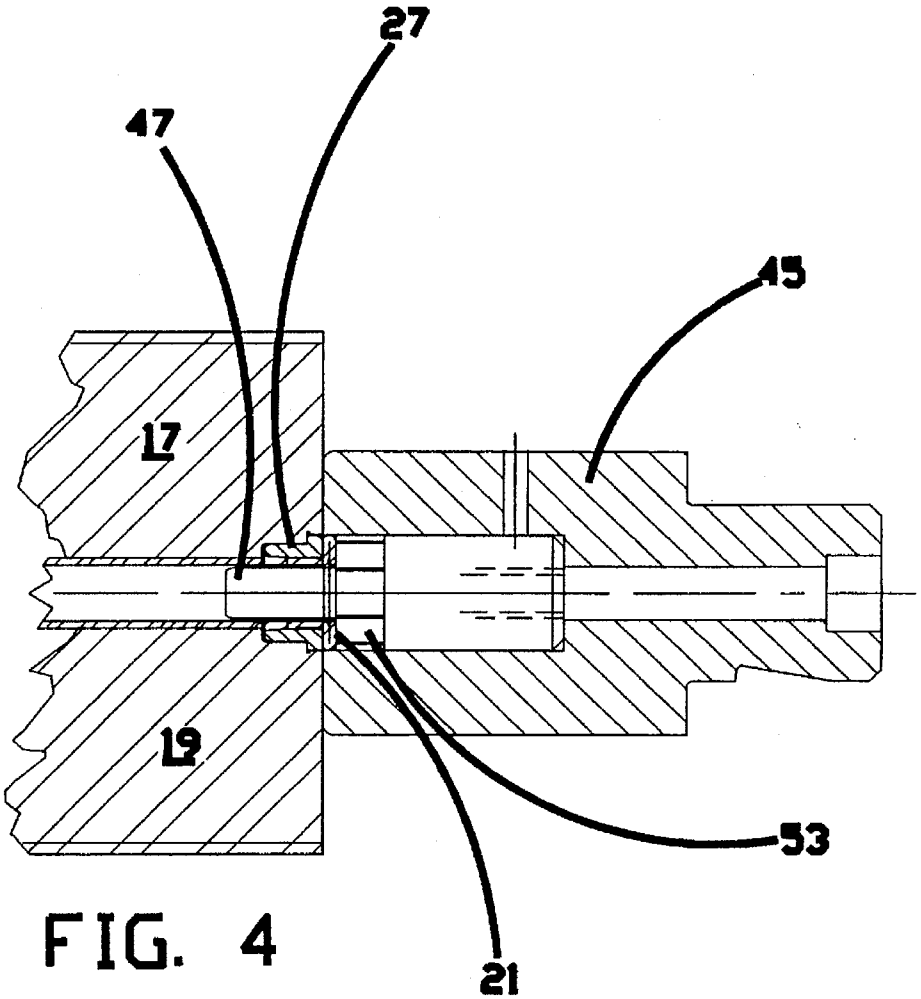
FIG. 4 is a cross-sectional view of an illustrative second station of such a two station punch and die apparatus.

At the second station, the die portions 17 and 19 still gripping the tubing section with the now radially expanded tubing end extending beyond those die portions are moved into alignment with a second outer punch 45 and a second alignment pin 47 of FIG. 4. While typically less efficient, different die portions could be employed at the second station if desired. The alignment pin or pilot punch 47 is moved into engagement with the tube end as indicated at 49 and the punch 45 lowered to form another annular cavity about the radially expanded tubing end as shown at 51. The second station has a further punch 53 which moves downwardly within the second formed annular cavity into abutment with the tubing end 21 to force that tubing end further axially toward the sleeve 27 and into the folded relationship with itself illustrated in FIG. 4. At the same time, the tubing end is allowed to expand radially outwardly further within the annular cavity. During this final axial impact 55, the punch 53 compresses the radially expanded tubing end to form a relatively flat face. The finished product is released from between the die halves as indicated at 57.

At the first station, the punch has a punch shank such as 59 of FIG. 5 which functions to drive the outer 31 and further 37 punches in unison until the outer punch 31 has securely seated the sleeve in the pocket and formed the annular cavity about the tubing section end at the end of step 39 of FIG. 1. There is a lost motion coupling between the punch shank 59 and the outer punch 31 which allows the shank to continue to move the further punch 37 after the outer punch has securely seated the sleeve in the pocket and formed the annular cavity about the tubing section end. This lost motion coupling comprises a helical spring 61 one end of which engages the shank at 63 and the other end of which engages the outer punch at 65. The coil spring compresses to the configuration shown in FIG. 5 after the outer punch has securely seated the sleeve in the pocket and formed the annular cavity about the tubing section end.

The method of operation of the invention should be clear from FIG. 1. The tube end experiences only two impacts, one at the first station by the punch and die of FIG. 3 and the other at the second station by the punch and die of FIG. 4.

In summary, the invention has a number of advantages over known prior techniques paramount of which is the elimination of one step in the production of doubly upset tubing flanges.

From the foregoing, it is now apparent that a novel tube end forming apparatus and technique have been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. A method of forming a sleeve-backed doubly-upset end on an elongated tube for subsequent sealing with another member, said method comprising the steps of:

first passing a sleeve over one end of an elongated tube, said sleeve comprising an annular rimmed member having a relatively flat face in a plane orthogonal to the longitudinal axis of the tube, then gripping the tube between die portions with a preferred length of tube extending axially beyond a flat end face of the die portions, and finally moving the sleeve along the end of the tube through the plane of the flat end face and into coplanar alignment therewith, such that the length of tube extending axially beyond the sleeve flat face is substantially equal to said preferred length;

passing a pilot punch into the tube end past the preferred length and radially inside the sleeve;

impacting the tube end with a frustoconical punch, forcing the tube end axially toward the sleeve while allowing a tube portion intermediate the tube end and the sleeve to expand radially outwardly;

impacting the tube end for a second and final time with a recessed flat punch to flatten the tube end, thereby forming the sleeve-backed doubly-upset end by the use of only two impacts of the tube end; and releasing the tube and sleeve from between the die portions.

2. The method of claim 1, including the further step of passing a second pilot punch into the radially expanded portion of the tube end prior to axially impacting the tube end for the second and final time.

* * * * *